US010932990B2

(12) United States Patent
Spallek et al.

(10) Patent No.: US 10,932,990 B2
(45) Date of Patent: Mar. 2, 2021

(54) TRANSFER SYSTEM FOR CONTAINERS

(71) Applicant: KOCHER-PLASTIK MASCHINENBAU GMBH, Sulzbach-Laufen (DE)

(72) Inventors: Michael Spallek, Ingelheim (DE); Johannes Geser, Gerlingen (DE); Karl Koeppel, Rainau (DE); Alexander Hammer, Gaildorf (DE)

(73) Assignee: KOCHER-PLASTIK MASCHINENBAU GMBH, Sulzbach-Laufen (DE)

( * ) Notice: Subject to any disclaimer, the term of this patent is extended or adjusted under 35 U.S.C. 154(b) by 457 days.

(21) Appl. No.: 15/570,417

(22) PCT Filed: May 6, 2015

(86) PCT No.: PCT/EP2015/000921
§ 371 (c)(1),
(2) Date: Oct. 30, 2017

(87) PCT Pub. No.: WO2016/177383
PCT Pub. Date: Nov. 10, 2016

(65) Prior Publication Data

US 2018/0153772 A1 Jun. 7, 2018

(51) Int. Cl.
*A61J 1/20* (2006.01)

(52) U.S. Cl.
CPC ..... *A61J 1/2089* (2013.01); *A61J 1/201* (2015.05); *A61J 1/2051* (2015.05); *A61J 1/2013* (2015.05)

(58) Field of Classification Search
CPC ..... A61J 1/2089; A61J 1/2013
See application file for complete search history.

(56) References Cited

U.S. PATENT DOCUMENTS 5,114,411 A * 5/1992 Haber ..... A61J 1/2089 604/203
5,478,337 A * 12/1995 Okamoto ..... A61J 1/2089 604/413

(Continued)

FOREIGN PATENT DOCUMENTS

EP 0 843 992 5/1998
JP 4-329956 11/1992

(Continued)

OTHER PUBLICATIONS

International Search Report (ISR) dated Jan. 28, 2016 in International PCT Application No. PCT/EP2015/000921.

*Primary Examiner* — Catharine L Anderson
*Assistant Examiner* — Arjuna P Chatrathi
(74) *Attorney, Agent, or Firm* — Wenderoth, Lind & Ponack, L.L.P.

(57) ABSTRACT

A transfer system for containers includes first and second containers (1), (5), which can be interconnected in a media-transferring way by a connection (7). The connection has a transfer device (27), when held in a locked position by a lock (25), prevents an exchange of media, and permits the exchange in an unlocked position in which the transfer device (7) is guided longitudinally movably in a seat (9) of the connection (7) for a transfer operation. The lock (25) is transferable to an unlocked position by the movement of at least one of the containers (5). The additional controls (13, 21) are present on the respective movable container (5), at least partially enclose the outer periphery of this container (5) and actuate the lock (25) of the transfer device (27) to unlock.

10 Claims, 15 Drawing Sheets

(56) References Cited

U.S. PATENT DOCUMENTS

| | | | | | |
|---|---|---|---|---|---|
| 5,826,713 | A * | 10/1998 | Sunago | A61J 1/2089 | 206/222 |
| 7,077,835 | B2 * | 7/2006 | Robinson | A61J 1/2089 | 604/413 |
| 2003/0069538 | A1 * | 4/2003 | Pfeifer | A61J 1/2089 | 604/82 |
| 2006/0235364 | A1 * | 10/2006 | O'Hare | A61J 1/2096 | 604/411 |
| 2012/0296307 | A1 * | 11/2012 | Holt | A61J 1/2055 | 604/407 |
| 2018/0116908 | A1 * | 5/2018 | Spallek | A61J 1/2089 | |

FOREIGN PATENT DOCUMENTS

| | | |
|---|---|---|
| WO | 95/00101 | 1/1995 |
| WO | 2015/075221 | 5/2015 |

* cited by examiner

TRANSFER SYSTEM FOR CONTAINERS

FIELD OF THE INVENTION

The invention relates to a container transfer system having at least one first container and at least one second container. The container is connected to one another in a media-conducting manner by a connection, which has a transfer device. When held in a locked position by device lock, the transfer device prevents an exchange of media. When in an unlocked position, the transfer device permits the exchange of media in which the transfer device is guided in a longitudinally displaceable manner in a seat of the connection for a transfer operation. The lock is able to be transferred to an unlocked position by the movement of at least one of the containers.

BACKGROUND OF THE INVENTION

Such systems make it possible for desired media, which constitute the ingredients of a specific container, to be brought into contact, dissolved or mixed with one another by the connection. Such operations are often required in the medical and pharmaceutical fields in order to produce preparations of at least two initially separate components, which must be mixed with one another before use. A particularly common application area is the production of preparations for parenteral applications for medical or diagnostic purposes. In the case of the production of preparations for parenteral purposes, for example, an infusion, it is often necessary to add to a solvent already located in the infusion bottle, such as water, isotonic NaCl solution, a glucose solution, a lactated Ringer's solution or the like, a drug, for example antibiotics, in liquid or powder form, which is to be dissolved in the solvent. In the medical field in particular, it is essential that errors are avoided during such a process. These errors are described in detail for example by E. A. Flynn et al. in "Observational Study of Accuracy in compounding i.v. mixtures at five hospitals" (Am. J. Health-Syst. Pharm. Vol. 54, Apr. 15, 1997, 904-912) on page 906. According to this source, the errors include: wrong drug, wrong dose, wrong volume of solvent, wrong composition of the solvent, wrong reconstitution process, amongst other things. Similarly, reference is made to the current shortcomings with respect to medical safety in parenteral applications by Richard Bateman et al. in the publication "Errors associated with the preparation of aseptic products in UK hospital pharmacies . . . " (Qual. Saf. Health Care 2010; 19: e 29) and by D. H. Cousins et al. in the publication "Medication errors in intravenous drug preparation and administration . . . ." (Qual. Saf. Health Care 2005; 14: 190-195).

Furthermore, it is desirable in particular for logistical reasons that the different components of the drug can be stored separately from one another when one component must be stored at a cool temperature, as is often the case for sensitive biotechnology products, which must be dissolved before the administration as an infusion in order to prevent the cold chain having to be extended to include the solvent.

Container transfer systems are state of the art for the simple and sterile realization of transfer operations for the above-mentioned objectives. A transfer system of the type described above is disclosed in WO 95/00101. In that known solution, the transfer device has, as a support for a piercing spike, which is formed in a conventional manner as a cannula with perforation tips located on both sides, a flexible support part in the form of a thin-walled plate. The plate simultaneously forms the locking device of the transfer device. For this purpose, the flexible plate has a nub-shaped circumferential edge, which engages in a latching groove on the inner side of the seat of the connection. When a corresponding mobile container is introduced into the seat, the perforable opening region of the mobile container comes into contact with the hollow piercing spike. With additional movement, the spike deforms the flexible plate of the transfer device in order to release the locking on the wall of the seat. The axial force acting on the locked latch mechanism depends on the perforation resistance at the opening region of the mobile container. The functional reliability of the lock therefore leaves a lot to be desired.

SUMMARY OF THE INVENTION

Based on this prior art, the problem addressed by the invention is to provide an improved container transfer system which is distinguished by improved functional reliability.

According to the invention, this problem is solved by a transfer system having, as a significant distinguishing feature of the invention, an additional control provided on the respective mobile container. The control at least partially surrounds this mobile container at the external circumference and activates the lock of the transfer device for an unlocking. The unlocking operation then takes place in a controlled manner, which increases safety with respect to operating errors.

In particularly advantageous exemplary embodiments, the additional control is provided on the outer side or face side of a cap part that, on the mobile container, surrounds an opening region. The opening region can be perforated by a hollow piercing spike of the transfer device. Alternatively, the control can be formed by the specific cap form itself or can be an integral component of the container in question.

The arrangement can particularly advantageously be such that the lock has a blocking element that, in the locked state, prevents the opening displacement movement of the hollow piercing spike of the transfer device and that can be transferred to the unlocked state allowing the displacement movement by mechanical contact with the control of the mobile container.

Because the invention allows the lock to be activated by a special control, the invention provides the particularly advantageous opportunity to form between the mobile container and the connection an encryption that rules out an operating error. In a particularly advantageous manner, it is possible to provide for this purpose that, in order to form an encryption that acts as a key-lock system between the mobile container and the connection as a control, a key element comprising a physical coding is provided on the mobile container, as the lock of the system. An opening having a physical coding provided on the inner side is provided on the body of the blocking element in such a way that, in the case of corresponding coding, the control of the container can be introduced into the opening of the blocking element in order to transfer the blocking element to the unlocked state. Consequently, a transfer operation can take place only with a container combination intended for a particular application, so that the safety required in particular in medical applications is guaranteed.

An important factor is that checking of the coding by the control and the blocking element can occur with only minimal force and on short, straight paths in order to make the application as intuitive and simple as possible and to prevent tilting. It is also advantageous for the coding to be redundant, for example, distributed many times in a uniform manner over the circumference, which prevents tilting and facilitates the orientation during introduction.

The coding of the key element can be formed on the cap part of the mobile container by recesses or projections provided at the circumference. In a manner corresponding thereto, the coding of the blocking element is formed by recesses and/or projections that are provided on the wall of its opening and that, in the case of corresponding coding, complement the recesses and/or projections of the mobile container.

In an advantageous manner, the connection can have, as a seat for the transfer device and the lock, a housing in the form of a cylindrical sheath. The sheath can be connected or is connected at the one end to a container, and is accessible at the other end for a mobile second container. Also, the sheath forms a guide for displacement movements of the transfer device and the lock.

The transfer device can have a disk as a support for a centrally located hollow piercing spike that projects on both sides of the disk. Guide parts for the guiding of the disk in displacement movements in the sheath are provided at the circumference of the disk as are locking elements that can be activated by the lock.

In this respect, the arrangement can be such that, at the circumference of the disk, first locking elements are provided, by which, in a start position, the disk is detachably latched on catches of the sheath against an opening displacement movement. Second locking elements are also provided which, in their normal blocking position, hold the blocking element in the locked state and which, by contact with the control of the mobile container introduced into the blocking element, can be controlled out of the blocking position into an unblocked position, in which they transfer the blocking element into the unlocked state.

The first and second locking elements can be formed on tongue parts that can move in a flexible manner relative to one another and that are formed in the form of tabs distributed at the circumference in the disks and raised from the disk plane.

The respective tab for the second locking element can have a control part that engages in the opening of the blocking element. By contact with the control of the mobile tab introduced into the opening, the blocking element moves the respective second locking element out of the blocking position and unlocks the blocking element. In the case of a provided key-lock encryption system, this unlocking operation can occur only when the control of the mobile flask can be sufficiently introduced into the opening of the blocking element in the case of corresponding coding.

When the unlocked state is reached, the blocking element can be moved by the mobile container to the disk of the transfer device, with the tabs being guided in control channels of the blocking element in such a way that the tongue parts forming the latching to the sheath are moved in the control channels in an unlatching manner. The transfer device then is free for the opening displacement movement and can be carried along for its opening movement by the movement of the blocking element.

It is additionally possible to form, for the tongue parts forming the latching to the sheath, second catches on the sheath. The second catches latch the transfer device in an end position at the end of a connection operation.

In order to fix the mobile container to the connection device by a form-fitting securing engagement when the end position is reached, inwards projecting detents can be provided at the circumference of the disk of the transfer device. The detents form, at the end position of the transfer device, a snap connection with a circumferential edge of the key element-comprising cap part of the mobile container.

Other objects, advantages and salient features of the present invention will become apparent from the following detailed description, which, taken in conjunction with the drawings, discloses preferred embodiments of the present invention.

BRIEF DESCRIPTION OF THE DRAWINGS

Referring to the drawings that form a part of this disclosure.

DETAILED DESCRIPTION OF THE INVENTION

Figure 1:
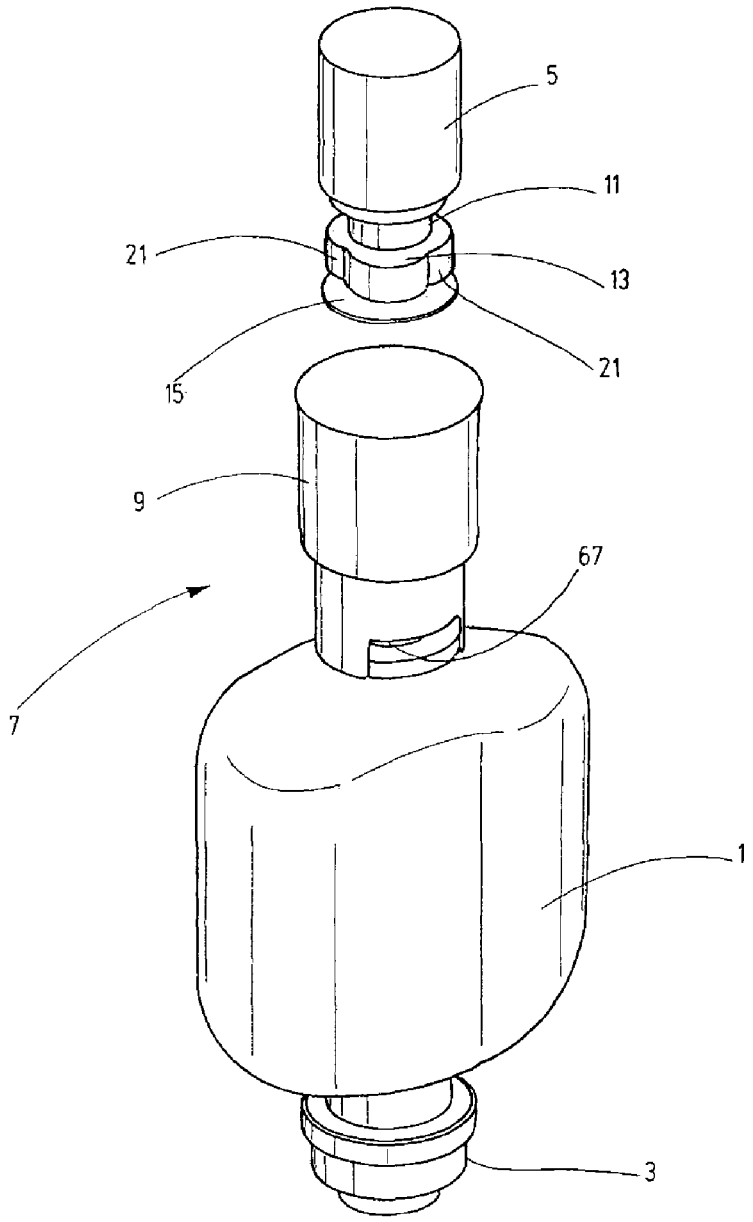
FIG. 1 is a perspective view of a container transfer system according an exemplary embodiment of the invention.

The invention is explained in detail below with reference to exemplary embodiments in which the transfer system is intended for a media exchange between containers. The containers are preferably used for medical, diagnostic, enteral or parenteral applications. In this regard, the specific exemplary embodiments depicted in the drawings show (see in particular FIG. 1) a first container in the form of an infusion container 1 in the form of a plastic container. Container 1 is produced, for example, using the known blow-fill-seal process, which is described for instance in EP 2 269 558 A1 and which is also known to experts in this field under the name Bottelpack® system. Such containers usually have at least one connection 3 for an infusion set. When, for the purposes of preparation of a specific infusion fluid, a liquid or powder-form additional media component, is to be added to the contents of the infusion container 1, which for example contains a volume of solvent, special safety requirements must be met.

In medical, diagnostic applications, in the case of the media transfer involving on the one hand an additional component, which is usually located in a glass flask or polymer flask 5 in such applications, it is not only necessary to pay attention to sterility. It is also necessary to ensure that the media transfer takes place from a flask 5, which contains a certain quantity of the respective required substance, into an infusion container 1. For such a transfer operation, which is to be realized in a simple and sterile manner, it is possible to proceed, as is disclosed in the document WO 95/00101, in such a way that a connection device can be mounted or is mounted on the infusion container 1. The connection device contains a transfer device with a hollow piercing spike in the form of a cannula that extends in a continuous manner between perforation tips. The connection device is normally locked in an inactive position, in which both perforation tips of the piercing spike are located at a spacing from a perforable opening region of the infusion flask 1 and from a perforable perforation region of the flask 5 provided for the transfer operation. The connection device has a cylindrical, sheath-shaped seat, into which the flask 5 provided for the transfer operation can be introduced. The sheath-shaped seat forms a guide for a displacement movement of the flask 5, during which the perforable opening region of the flask 5 approaches the piercing spike. The flask displacement movement releases the locking of the transfer device and moves the transfer device into an end position, in which the hollow piercing spike perforates the opening regions of the flask 5 and infusion flask 1 and establishes the media connection.

The container transfer system according to the invention is in this regard based on the same functional principle. The essential difference of the invention with respect thereto is however that an unlocking of the transfer device 27 such that the establishment of a media-conducting connection is only possible when using a mobile container specifically provided for the respective transfer operation, i.e. the flask 5. According to the invention, special controls are provided on the mobile flask 5. By those controls, the locking device of the transfer device can be unlocked. The risk of operating errors that exists with the above-mentioned prior art, that is to say a combination/mixing of substances and/or volumes that is not permitted, is then ruled out thanks to an encryption between the flask 5 and the connection device 7. The particulars of the invention permitting such an encryption between the flask 5 and the connection device 7 can be more clearly seen in the additional FIGS. 2-34.

Figure 2:
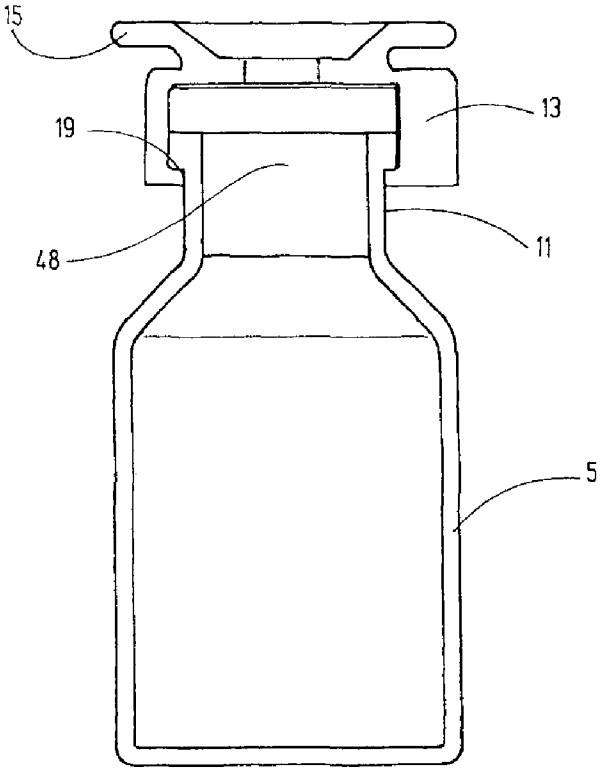
FIG. 2 is a schematically simplified, side view in section of a container in the form of a flask containing a media component, the content of which flask is to be transferred to a second container by the transfer system according to the invention.
Figure 3:
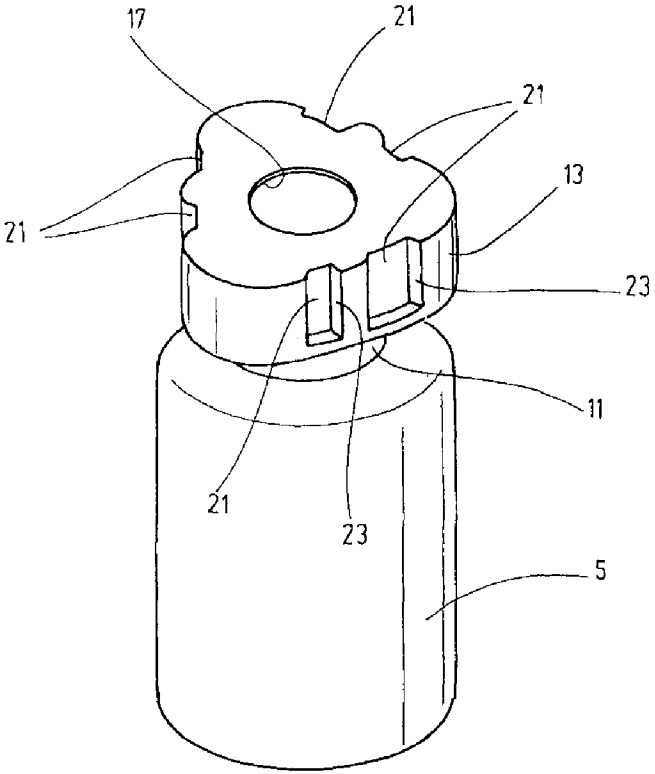
FIG. 3 is a perspective view of the flask of FIG. 2, depicted with removed cap cover part.

It can be seen from FIGS. 2 and 3, which separately depict a mobile flask 5. A cap part 13, for example in the form of an elastomer plug (not depicted in detail) is mounted on the neck part 11 of the flask 5, on which the perforable opening region 48 is located. The cap part has in the current example of an integral injection molded plastic part. FIGS. 2 and 3 show the cap part 13 in the initial state before usage, with a molded cover 15 serving as a genuineness indicator being located on the top side of the cap part 13. Cover 15 can be removed in a simple manner and without necessary auxiliary tools, for example, by breaking off, levering off or twisting off in order to use the flask 5. Instead of the cover 15, a removable foil could be provided. After removal of the cover 15, a central opening 17 is exposed on the cap part 13, which central opening is aligned with the perforable opening region 48 on the neck part 11 of the flask 5. If a radiation-permeable foil is provided instead of the cover 15, such foil can be irradiated with high-energy radiation, e.g., UV radiation or beta radiation, in order to kill any germs which may be present on the elastomer surface (perforation surface). The cap part 13 is preferably formed from a polymer and can, as FIG. 2 shows, be connected in a form-fitting, force-fitting or bonded manner to the edge 19 of the neck part 11 of the flask 5. Alternatively, the coding of the cap part 13 could be an integral component of the flask 5. Alternatively, caps 13 according to the invention with coding can also be part of multi-part plastic closures known per se, as described for example in WO 2011/032798 A1, WO 2011/039004 A1 and EP 0 655 042 B1, which are advantageously used in particular in the freeze-drying of drugs or medicinal products.

Figure 7:
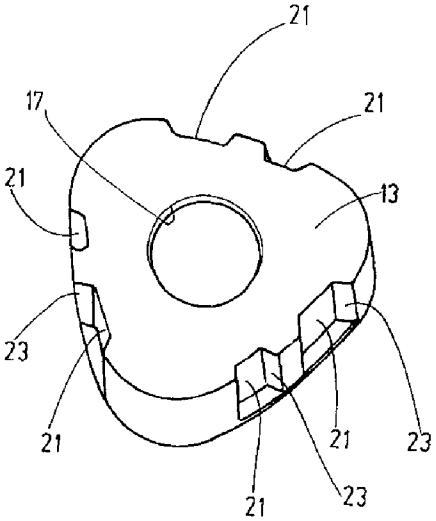
FIG. 7 is a perspective view of the cap part of the mobile flask, viewed on the free end face.
Figure 8:
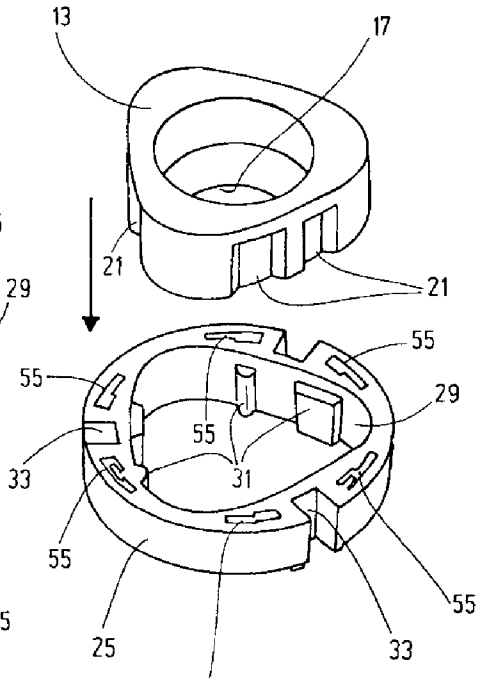
FIG. 8 is, in an exploded perspective view of an encryption system functioning according to the key-lock principle, with the cap part of FIG. 7 forming the key element being depicted before the introduction into the blocking element of FIG. 6 serving as the lock of the system according to the exemplary embodiment of the invention.
Figure 6:
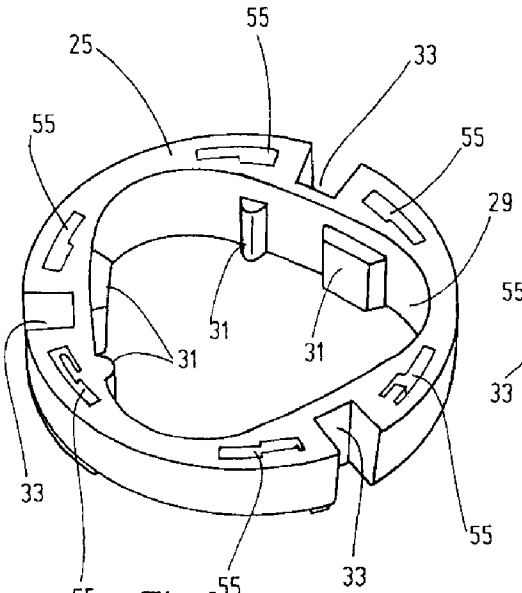
FIG. 6 is a perspective oblique view of the blocking elements of the connection of the exemplary embodiment.

The contour of the cap part 13 has the form of a Reuleaux triangle with rounded edges. In order to form the encryption in accordance with the key-lock principle, the cap part 13 with the external circumference of the Reuleaux triangle forms a physically coded key element, with the coding on the cap part 13 being formed by recesses 21. The recesses 21 have the form of grooves that are sunk inwards from the circumference, the circumferential length of said grooves being delimited by walls 23 that, relative to the central opening 17, define radial planes and with only a few of these walls 23 being numbered in FIG. 7. The axial depth of the recesses 21 is smaller than the thickness of the cap part 13, so that the recesses 21 on the front face visible in FIG. 7 are open. The side of the cap part 13 that faces the main part of the flask 5 and that is visible in FIG. 8 is free of recesses 21.

Figure 5:
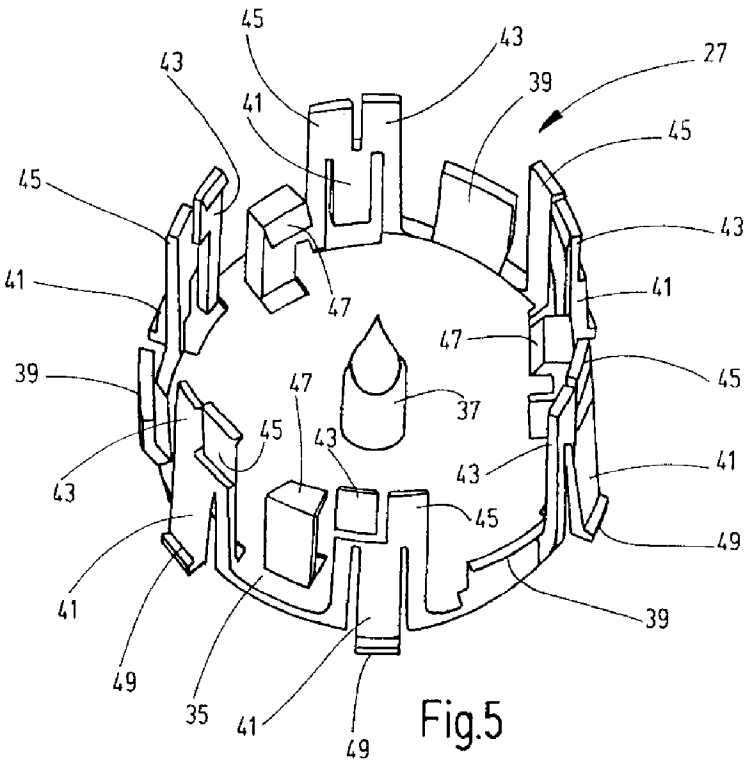
FIG. 5 is a perspective view of the media transfer device forming a component of the connection.

As a codable lock for the key-lock system, an annular body 25 (see in particular FIGS. 6 and 8) is provided, which forms a blocking element as a component of the locking device of the transfer device 27, which is depicted separately in FIG. 5. The annular body 25 has an opening 29 for the introduction of the key element formed by the cap part 13. Opening 29 is adapted to the circumference of the cap part 13, in other words, it has the form of a Reuleaux triangle. On the inner side, the opening 29 is provided with a coding in the form of projections 31 that, in the case of corresponding coding, complement the recesses 21 of the key part on the cap part 13. The projections 31 do not extend up to the edge of the annular body 25 lying at the top in FIG. 6 so that, for the contacting of the cap part 13 at the start of a transfer operation an alignment plane is defined, on which the cap part 13 can be brought into the rotational position of the alignment of the recesses 21 and projections 31. In the case of corresponding coding, cap part 13 can then be introduced into the opening 29 of the annular body 25. In particular, viewed in the viewing direction of FIG. 8, the projections 31 form shoulders in the upwards direction, which can be brought into contact with the corresponding shoulders on the set back ends of the recesses 21 of the cap part 13, so that in an axial feed movement of the container or flask 5 towards the infusion container 1, the cap part 13 necessarily carries along the annular body 25.

Figure 4:
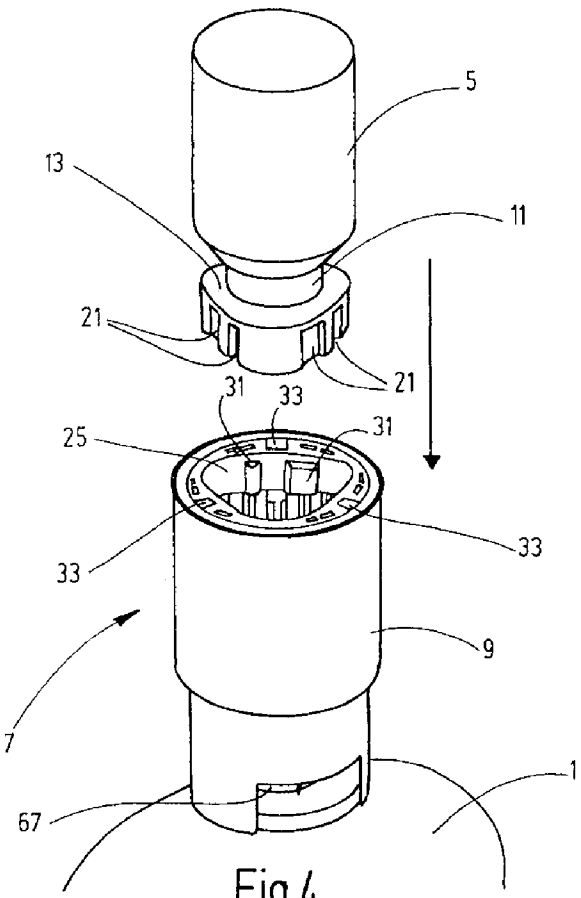
FIG. 4 is a partial perspective view, depicted in an exploded manner, of the exemplary embodiment, with the state before the introduction into the connection of the transfer system being depicted.

FIG. 4 shows the initial state before the start of a transfer operation. The annular body 25 is located at the top end of a sheath-shaped seat 9 of the connection device 7. As is shown most clearly by FIG. 6, the annular body 25 forming the blocking element has at the external circumference axially continuous grooves 33. By grooves 33, the annular body 25 is guided on (not depicted) axial guide rails of the sheath-shaped seat 9. The transfer device 27 depicted separately in FIG. 5 is guided in an axially displaceable manner below the annular body 25 in the sheath-shaped seat 9 for its opening movement. As FIG. 5 most clearly shows, the transfer device 27 has a disk 35 adapted to the internal diameter of the sheath-shaped seat 9 as a support for a centrally arranged piercing spike 37. In a manner known per se, spike 37 is formed as a multichannel cannula and projects on both sides of the disk 35 in order to perforate both the opening region 50 of the infusion flask 1 and the opening region 48 of the flask 5 for the opening operation. Raised functional elements are located at the circumference of the disk 35. Of these functional elements, three guide tabs 39 guide the disk 35 in travel movements on the inner wall of the sheath-like seat 9. Located between two consecutive guide tabs 39 there are in each case two tabs with three tongue parts 41, 43 and 45 connected to one another. In addition, inwards projecting lugs 47 are located above the surface of the disk 35 for the formation of a snap connection, as will be discussed below.

Figures 9, 10, 11:
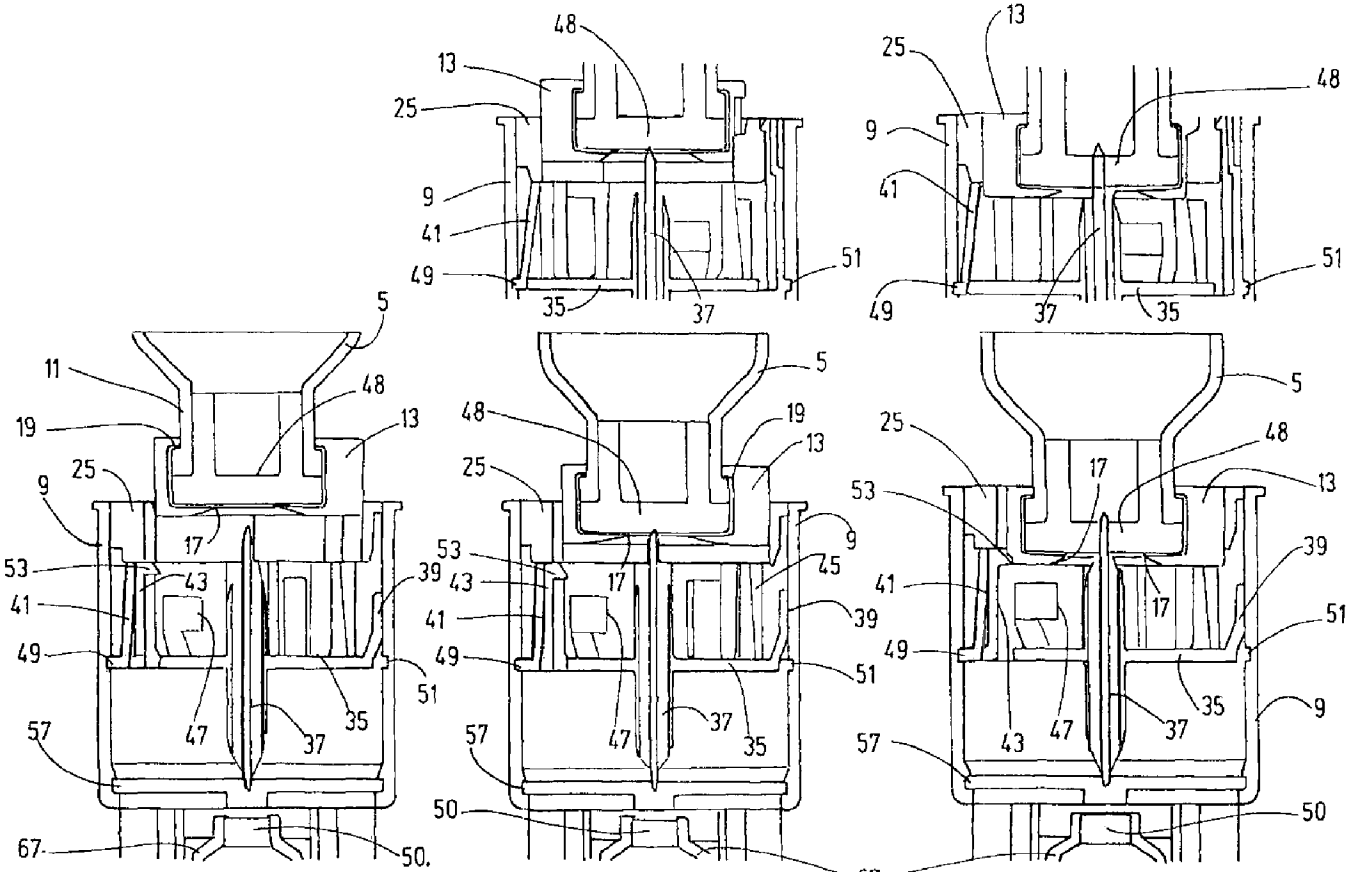
FIG. 9 is a schematically simplified partial side view in section of the connection containing the transfer device and of the associated opening region of the mobile flask, with the flask being depicted with its cap part in a centered position before the introduction into the blocking element of the connection.
FIG. 10 is a schematically simplified partial side view in section of the connection at, a further stage of the connection/transfer operation, with the cap part of the flask being partially introduced into the blocking element in the case of corresponding coding of the key element of the flask and of the blocking element serving as the lock and, with the part at the top of FIG. 10 showing a section plane rotated 90° relative to FIG. 9.
FIGS. 11 to 15 are schematically simplified, partial side views in section of the connection in which successive positions in the process of a connection/transfer operation are depicted.
Figure 14:
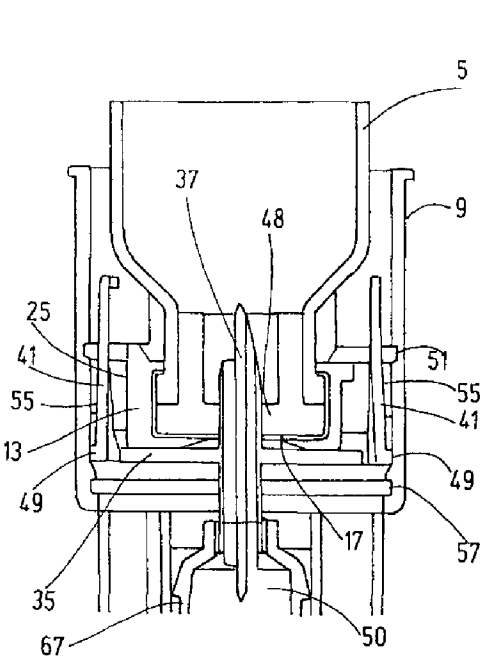
Figure 13:
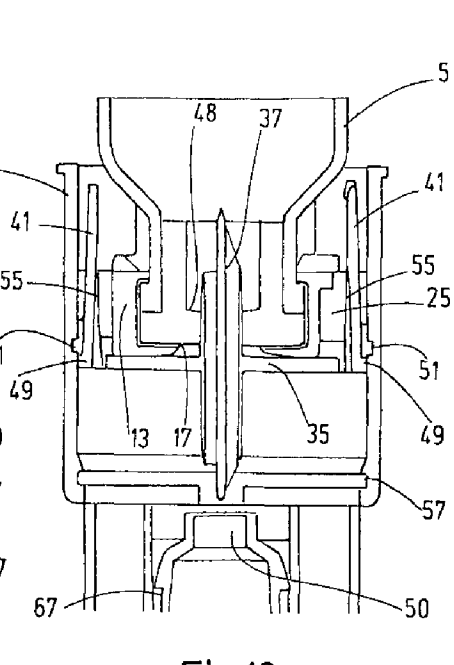
Figure 12:
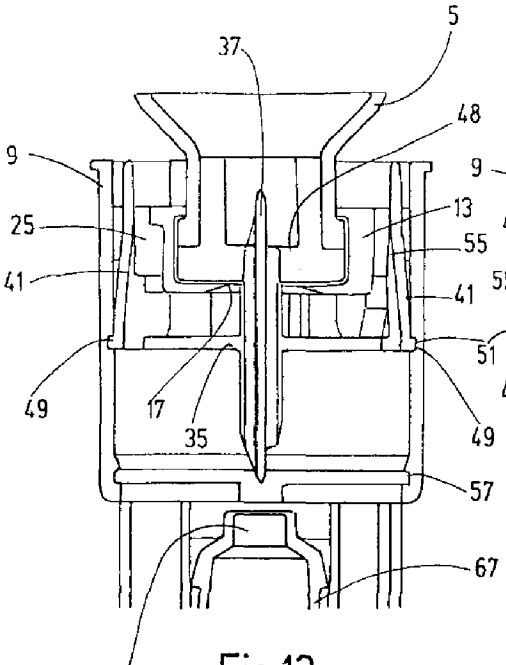

As FIG. 4 shows, the annular body 25 forming the blocking element of the locking device is located at the top edge of the sheath of the seat 9. The annular body 25 is in the locked state, i.e. the not axially moveable state. The transfer device 27 located under the annular body 25 is in turn locked against an axial displacement movement, because the disk 35 with the detents 49 on the tongue parts 41 that splay outwards slightly is latched in a latch groove 51 of the sheath. The annular body 25 serving as a blocking element is thus also in a locked position, because the tongue parts 45 of the raised tabs of the disk 35 prevent the movement of the annular body 25. This state is depicted in FIG. 9. When the codings of the cap part 13 of the flask 5 and of the annular body 25 correspond, the cap part 13 can be introduced into the annular body 25, as is shown by FIGS. 10 and 11. In the course of this movement, the spike 37 perforates the opening region 48 of the flask 5, and the cap part 13 comes into contact with a control lug 53 on the tongue parts 43. During the further introduction movement of the cap part 13, the tongue parts 43, 45 are then moved for the unlocking operation. The annular body 25 is then displaceable towards the disk 35 of the transfer device 27, with the tongue parts 41, 43, 45 of the tabs being guided in guide channels 55 of the annular body 25 in such a way that the catches 49 on the tongue parts 41 are raised from the catch groove 51 of the sheath of the seat 9. The achievement of this state is depicted in FIG. 13. The flask 5 with the cap part 13 can then be further introduced as FIG. 14 shows, with the annular body 25 being carried along, which annular body in turn contacts on the disk 35 of the transfer device 27 and carries along same for the opening movement, see FIG. 4, with the piercing spike 37 also perforating the opening region 50 of the infusion container 1. For the purpose of a transfer operation, the hollow piercing spike 37 has two transfer channels extending parallel to the respective piercing device.

Figure 16:
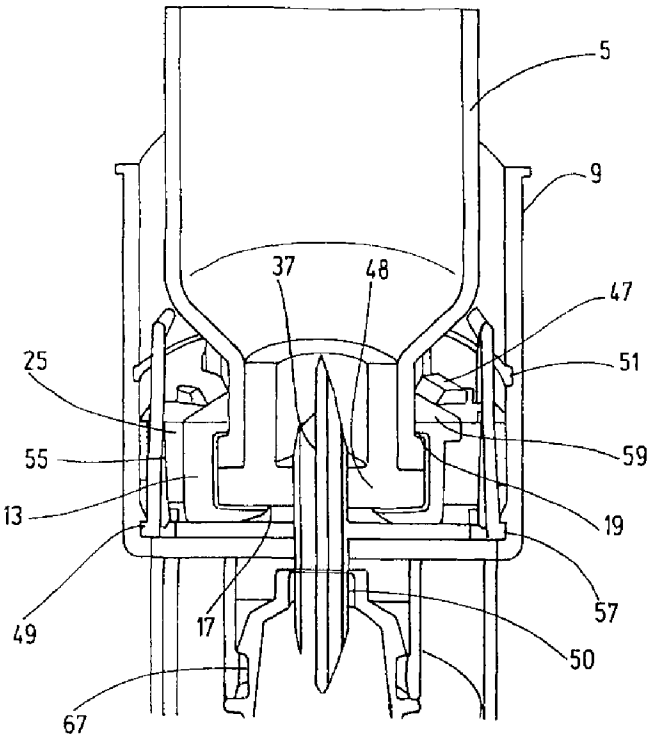
FIG. 16 is a partial perspective view of the connection corresponding to FIG. 15.
Figure 15:
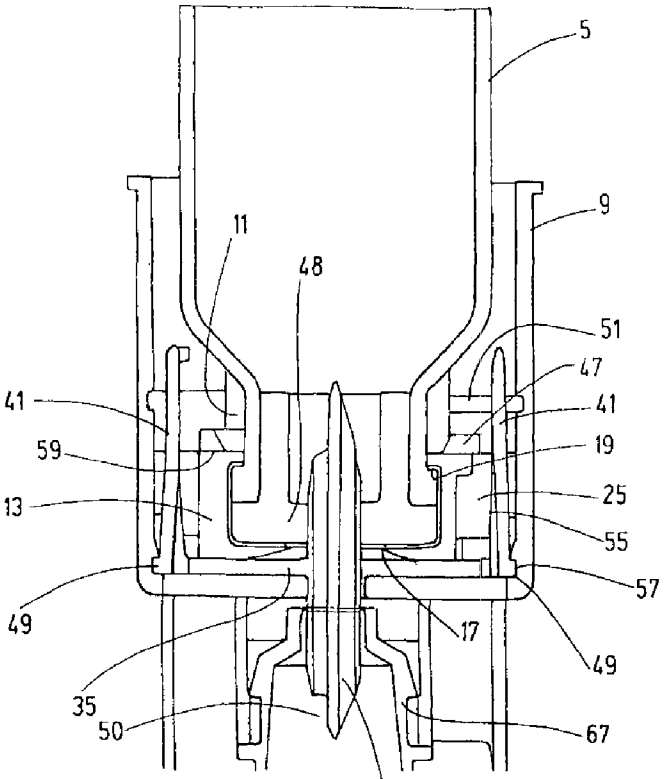

At the base of the sheath of the seat 9 there is an additional catch groove 57 for the formation of a catch for the transfer device 27 in the end position at the conclusion of the connection operation, as is depicted in FIGS. 15 and 16. In this end position, the lugs 47, which, as FIG. 5 depicts, project inwards above the disk 35, form a snap connection with the cap part 13 in that they overlap the edge 59 thereof that is free of the recesses 21, see FIG. 16. The flask 5 is then secured in a form-fitting manner on the connection device 7 when the end position of the transfer operation is achieved.

Figure 17:
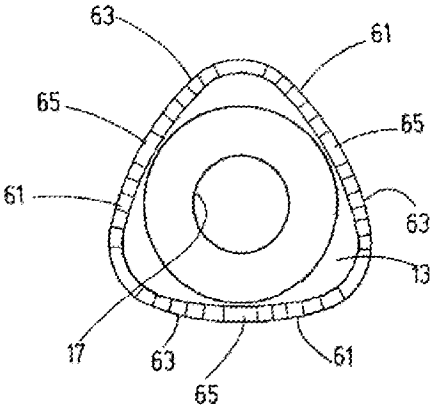
FIG. 17 is a top plan view illustrating the coding principle, the contour of the cap part of the flask forming the key element, with two coding regions for a respective subgroup of the coding being illustrated at each of the three sides of the Reuleaux triangle shape.

FIGS. 17 to 25 illustrate, in the form of functional diagrams, the encryption system provided in the depicted exemplary embodiment. FIG. 17 shows that, on the circumference of the cap part 13, which has the form of a Reuleaux triangle with rounded edges, a coding region is provided on each triangle side. Each coding region has two groups 61 and 63 with coding positions and the groups 61, 63 being spatially separated from one another by a code-free intermediate region 65. Because the same code groups 61, 63 are provided on each triangle side with code positions identically selected for the formation of a corresponding key, the key element can be inserted in three positions (orientations) into a respective identically coded lock. For the present application, the coding of code positions of one of the groups 61, 63 identifies the filling volume of the corresponding flask 5, while the respective other group 61 or 63 represents the nature of contents of a container. In the present example, as mentioned, the coding on the cap part 13 is in each case formed by recesses 21 provided inside the groups 61, 63. The sketch-type depiction of FIG. 17 depicts the unprocessed state, without coding by recesses 21.

In the present example, the coding in the respective group 61 identifies the nature of container contents, for example the nature of a solvent located in the infusion flask 1, while the coding of the group 63 identifies a volume, for example the volume of a solvent, to which a substance located in the flask 5 is to be added or can be added. On the annular body 25 forming the lock, in a corresponding manner the projections 31 identify for the respective coding groups 61, 63 the volume of the infusion flask 1 or the nature of container contents, for example of the specific solvent located in the infusion flask 1.

Figure 19:
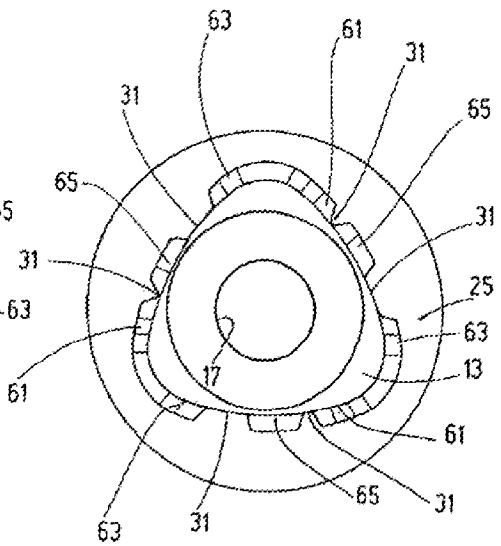
FIGS. 18 and 19 are plan views of a cap part inserted into the blocking element, which in turn has a coding allowing the insertion.
Figure 18:
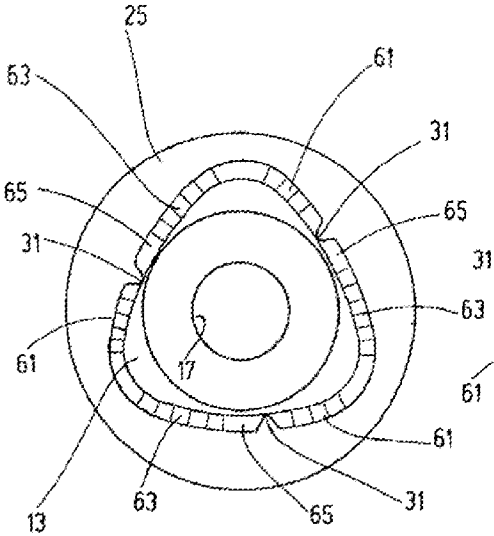

FIG. 18 shows an example in which the cap part 13 signals by a recess 21 in a first coding position of the group 61 that the flask 5 is intended for supply to a constituent A of flask 1, while the group 63 does not contain any recess 21, which in turn signals that the flask 1 contains a certain solvent volume. In the example of FIG. 19, a recess 21 is formed in the groups 63 over several coding positions, which signals a different solvent volume, while a recess in the groups 61 at a coding position different from that of FIG. 18 signals a different solvent, for example a solvent B, for example 50 ml, corresponding to the recess in the group 63.

Figure 22:
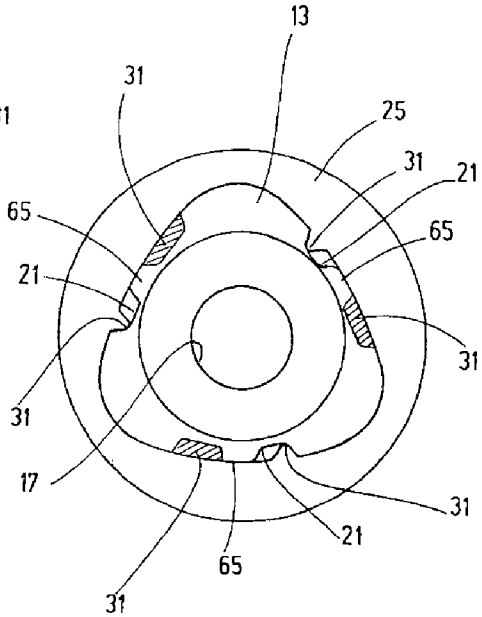
FIGS. 20 to 22 are top plan views of a cap part with two additional coding examples.
Figure 21:
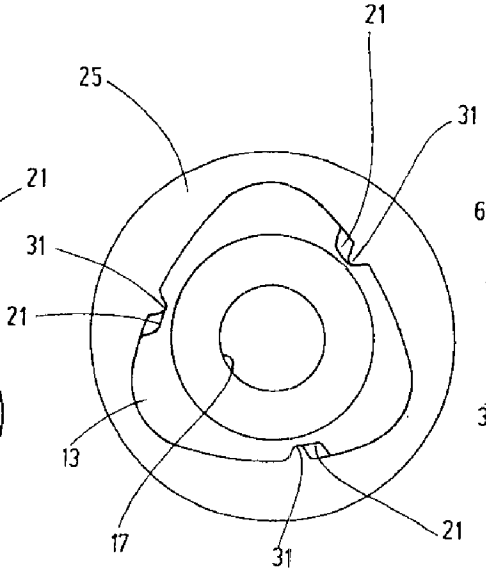
Figure 20:
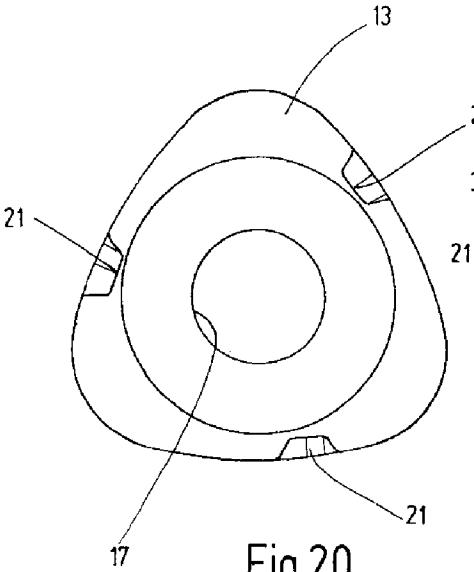

FIGS. 20 to 22 show examples in which the flask 5 signals by longer recesses 21 in the groups 61 that it is intended both for the media supply to a solvent A and also to a solvent B in the flask 1. The absence of a recess 21 in the groups 63 simultaneously signals that the addition is intended only for a certain solvent volume in the flask 1, for example 250 ml. Accordingly, the example of FIG. 21 shows that the flask 5 can be combined with a flask 1 that contains the solvent A at a volume of 250 ml. As FIG. 22 shows, the combination is not however possible with a flask 1 that contains the solvent B at a different volume, for example 50 ml.

Figures 23, 24, 25:
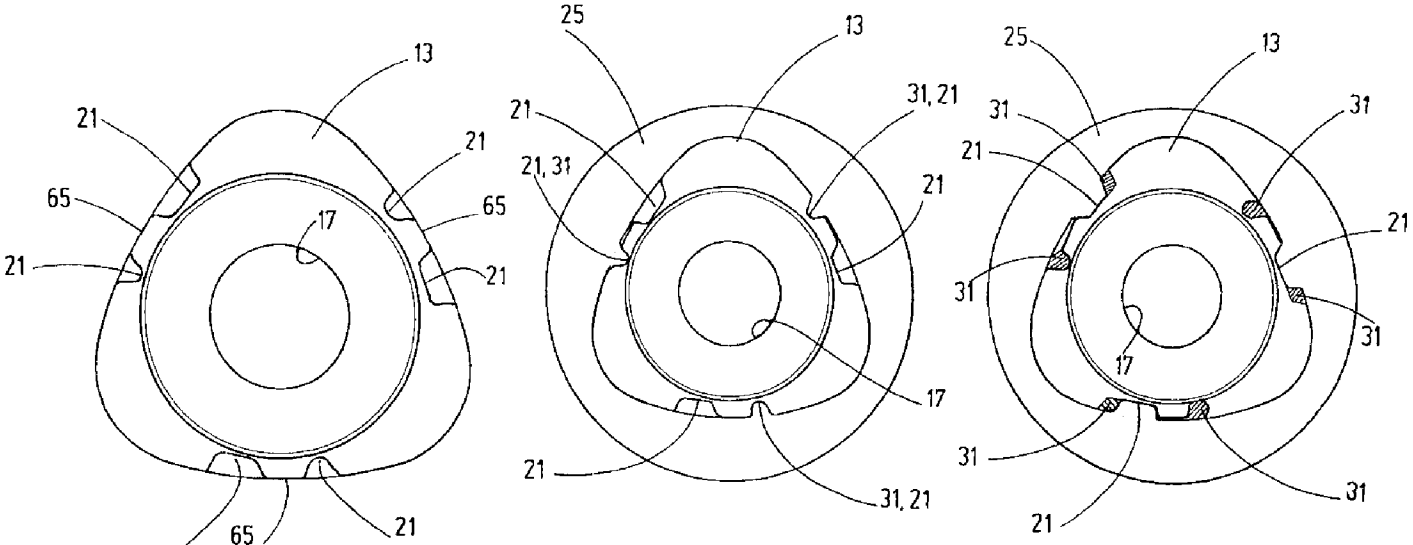
FIGS. 23 to 25 are top plan views of a cap part with two further examples of the coding.

In a manner corresponding to FIGS. 20 to 22, FIGS. 23 to 25 illustrate examples in which the flask 5 signals by a recess 21 in only one coding position of the group 61 that the flask 5 is intended only for a solvent A in the flask 1, whereas it is signaled by a recess 21 over two coding points of the group 63 that combination across a greater volume range is permitted, for example for 100 to 250 ml of the solvent. As FIG. 24 shows, the flask 5 corresponds to an infusion flask with the solvent A at a volume of 250 ml. By contrast, FIG. 25 shows that combination is ruled out in the case of a different solvent B as well as in the case of a different solvent volume.

Figure 28:
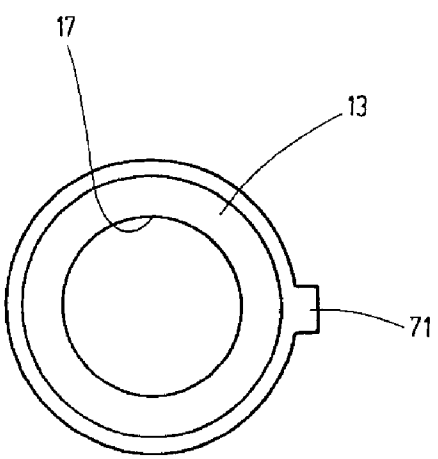
FIGS. 26 to 28 are top plan views illustrating different contour shapes for the key element on the cap part of the mobile flask.
Figure 27:
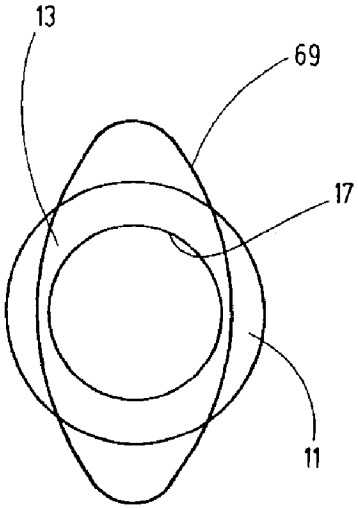
Figure 26:
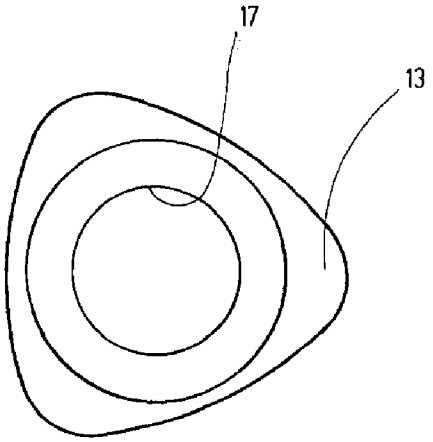

FIGS. 26 to 28 illustrate, in sketch-type depictions, additional options for forming the contour of the uncoded key element, with FIG. 26 showing the triangular form selected in the in this respect described exemplary embodiment, while FIG. 27 shows a different, non-circular contour form in the form of a kind of ellipse 69. It is also possible in the case of a circular contour form to provide design irregularities, as FIG. 28 shows, such as a pattern of projections and recesses, of which only one projection 71 is depicted in FIG. 28, which can in turn be provided in groups that are spaced apart from one another. In the case of a circular configuration, the key-lock connection is only possible in an unambiguous, relative introduction position (orientation), while coding groups can be provided on both long curve sides in the case of the ellipse 69 depicted in FIG. 27 so that the key-lock connection is possible in two relative rotational positions. In order to form corresponding coding groups, instead of the projections recesses of a component can also be provided, which then fit with projections of the respective other component.

Figure 29:
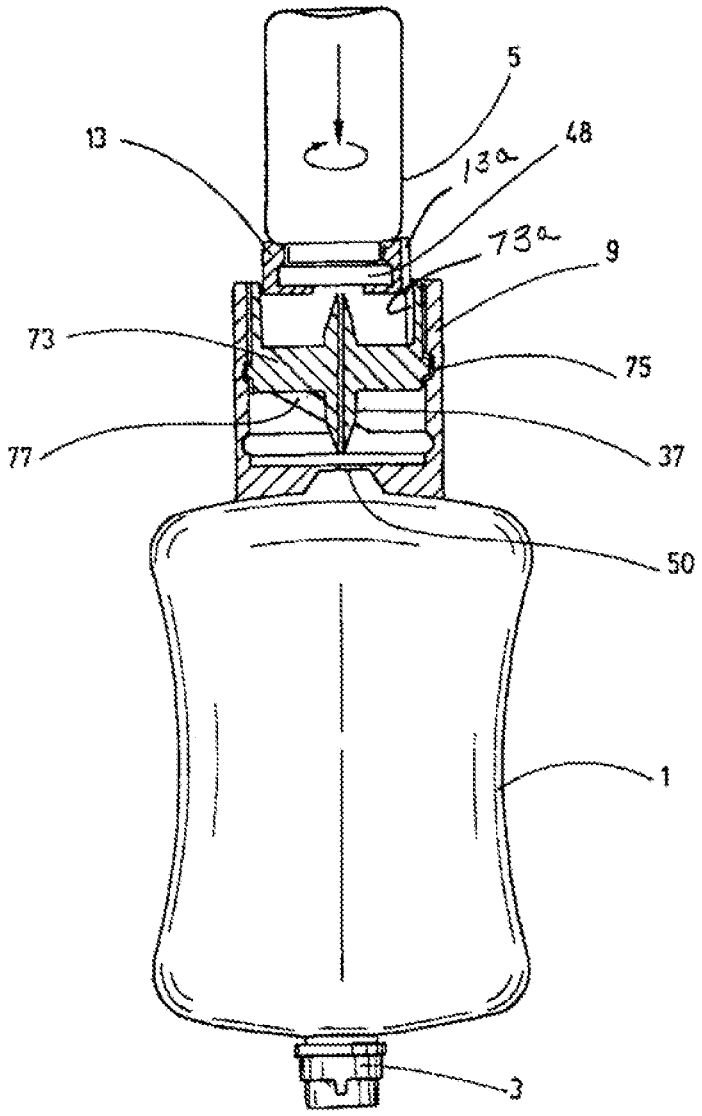
FIG. 29 is a highly schematic side view partially in section, of a second exemplary embodiment of the container transfer system according to the invention.

FIG. 29 illustrates, in a very schematically simplified depiction, an exemplary embodiment, in which the body 73 of the transfer device supporting the hollow piercing spike 37 itself forms a kind of pot. The body inner wall forms the lock element. The cap part 13 of the flask 5 can, in the case of corresponding coding, be introduced in body 73. The cap part 13, when it contacts on the body 73, displaces body 73 for the perforation operation. Because the body 73 is guided in the displacement movement with its circumferential rib 75 in a thread path 77 of the sheath of the seat 9, the perforation operation advantageously takes place with a rotational movement of the piercing spike 37. Splines 13*a* on cap part 13 and splines 73*a* on body 73 engage when the cap part 13 is inserted in body 73. The engagement of splines 13*a*, 73*a* cause container 5 and body 73 to rotate together.

Figure 30:
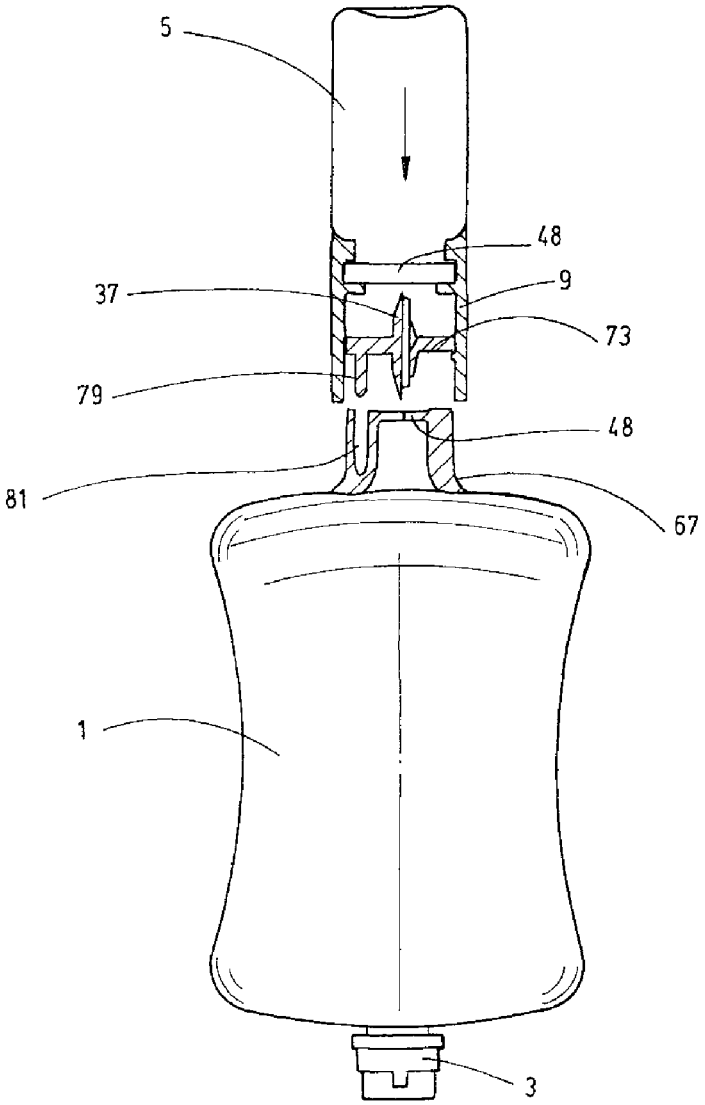
FIGS. 30 and 31 are highly schematic side views partially in section of a container transfer system according to a third and fourth exemplary embodiments, respectively, of the invention.

FIG. 30 illustrates, in a very schematically simplified depiction, another exemplary embodiment of the key-lock design. In this example, the sheath body forming the seat 9 of the connection device and the body 73 of the transfer device supporting the piercing spike 37 are already premounted on the flask 5, with this opening region 48 not yet being pierced however. The coding of the key-lock system provides for a pin 79 or several pins on the body, which can be introduced into corresponding bores 61 formed as a lock on the neck part 8 of the flask 1 in a coded arrangement.

Figure 32:
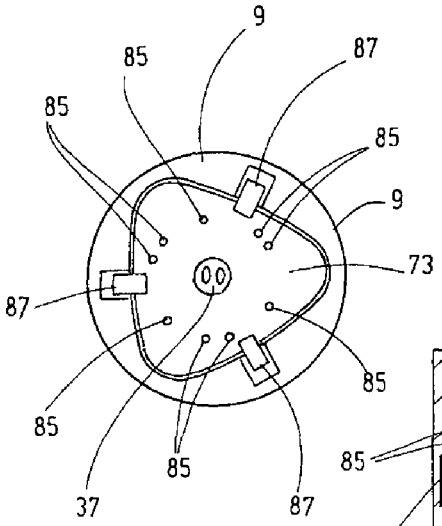
FIG. 32 is a cross-sectional view of the transfer device of the exemplary embodiment of FIG. 31.
Figure 31:
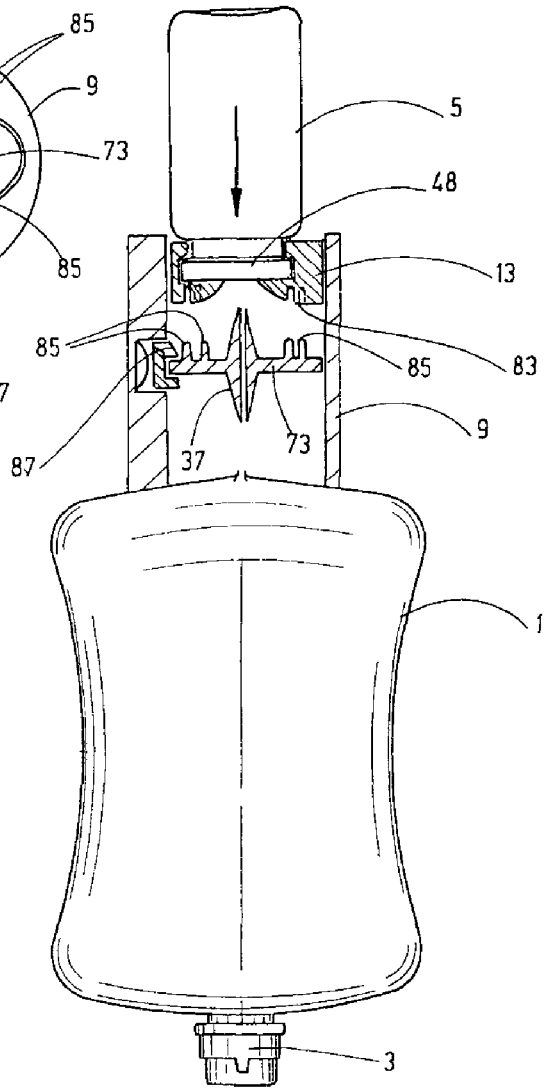

The exemplary embodiment of FIGS. 31 and 32 provides, as a key on the cap part 13 of the flask 5, a pattern of axial bores 83 and a corresponding pattern of pins 85 on the support 73 of the piercing spike 37. In the case of corresponding coding of bores 83 and pins 85, the cap part 13 can be contacted against locking parts 87, in order to release the locking of the body 73 on the seat 9, so that the body 73 can be displaced for the connection operation by means of introduction of the flask 5.

Figure 34:
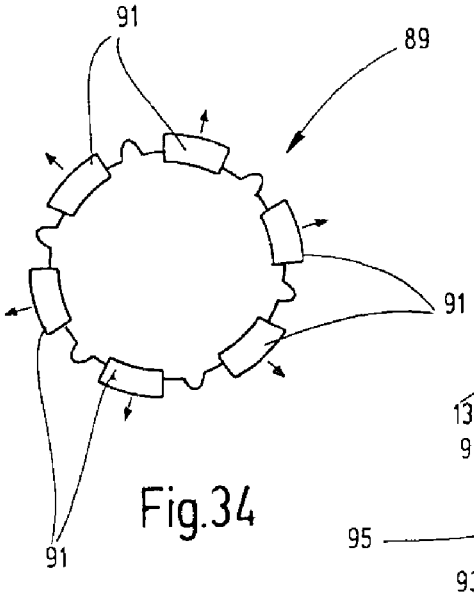
FIG. 34 is a schematic top plan view of the blocking element of the exemplary embodiment of FIG. 33.
Figure 33:
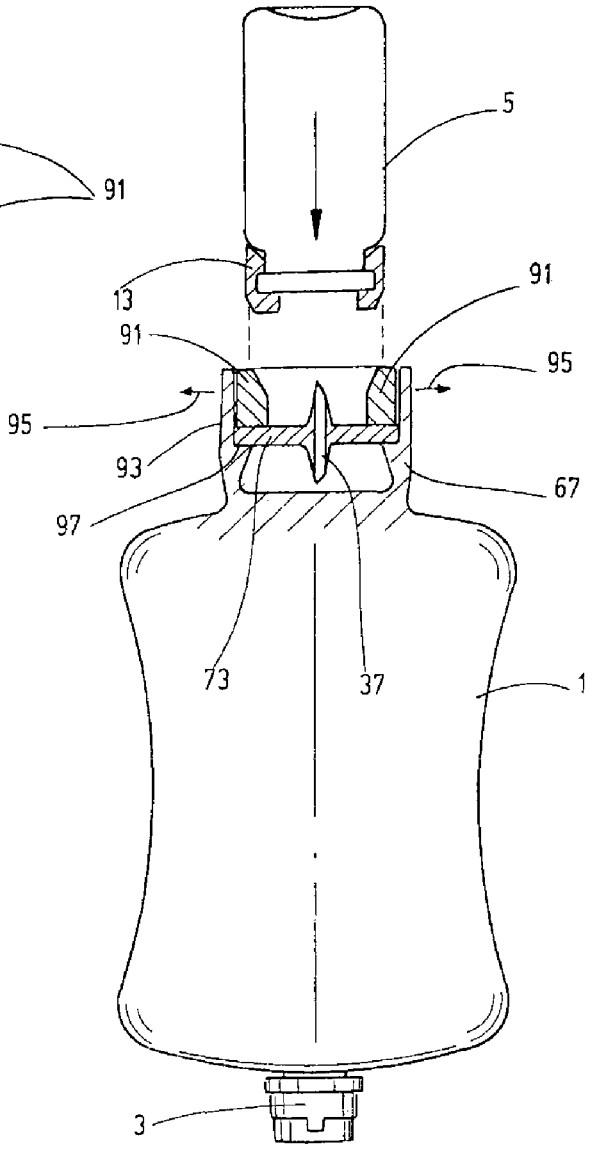
FIG. 33 is a high schematic side view partially in section of a container transfer system according to a fifth exemplary embodiment of the invention.

The exemplary embodiment of FIGS. 33 and 34 provides, for the unlocking of the body 73 supporting the spike 37, a ring 89 made up of flexibly connected pressure bodies 91, depicted separately in FIG. 34. By the cap part 13 of the flask 5 being introduced in the case of corresponding coding, these pressure bodies 91 can be splayed apart in such a way that the surround 93 of the body 73 formed on the flask neck 1 is expanded, as is indicated with the arrows 95. The body 73 then is released from a step 97 of the surround 93 for the displacement- and opening movement.

The solution according to the invention permits connection of all kinds of media-conducting and media-containing containers. In the broadest sense, these containers include hose systems, connected to one another in a sterile and fluid-tight manner for the purpose of a media exchange.

While various embodiments have been chosen to illustrate the invention, it will be understood by those skilled in the art that various changes and modifications can be made therein without departing from the scope of the invention as defined in the claims.

The invention claimed is:

1. A container transfer system, comprising:

first and second containers;

a connection device connecting the first and second containers to one another in a manner conducting media from one of the containers to the other container;

a transfer device of said connection device having a lock releasably holding said transfer device from exchanging the media between said first and second containers, and allowing longitudinal movement of said transfer device in a seat of the connection device to an unlocked position permitting exchanging of the media between the first and second containers by relative movement between said first and second containers;

a control on and partially surrounding an external circumference of said second container actuating said lock to allow movement of said transfer device from the locked position to the unlocked position;

a housing having a sheath shape, being connected at a first end of said housing to said first container, being accessible at a second end of said housing opposite to said first end for receiving said second container, and forming a guide for movement of said transfer device and said lock in said housing;

a disk of said transfer device supporting a centrally located hollow piercing spike projecting on both sides of said disk;

first locking elements on an outer circumference of said disk being actuatable by said lock and being detachably latched on first catches on said housing in a start position against movement of said transfer device from the locked position to the unlocked position, said first locking elements being tabs formed on flexible tongue parts that are movable relative to one another, said tongue parts extending from a plane of said disk, said first locking elements being latched to second catches on said housing in the unlocked position; and a blocking element movably mounted in said housing upon insertion of said second container in said housing and moves with said second container toward said disk with said tabs being guided in control channels in said blocking element and with said tongue parts unlatching from said housing freeing said transfer device for movement with said second container to the unlocked position for media transfer.

2. A container transfer system according to claim 1 wherein said control is on an outer side of a cap part of said second container and surrounds an opening region on said cap part perforated by said piercing spike of said transfer device upon movement toward the unlocked position.

3. A container transfer system according to claim 2 wherein said control is an integral component of said cap part.

4. A container transfer system according to claim 1 wherein first and second key elements on an inner side of said housing and on an outer side of said second container, respectively, forming an encryption acting as a key-lock system with physical coding allowing said second container to enter said housing to activate said transfer device only when said first and second key elements can properly mate.

5. A container transfer system according to claim 4 wherein said second key elements are on an outer circumference of a cap part of said second container and comprise at least one of recesses or projections.

6. A container transfer system according to claim 5 wherein said first key elements comprise at least one of recesses or projections in an opening of said housing receiving said cap part.

7. A container transfer system according to claim 1 wherein said housing is cylindrical.

8. A container transfer system according to claim 1 wherein said disk comprises guide parts at said outer circumference of said disk guiding movement of said disk in said housing.

9. A container transfer system according to claim 1 wherein said disk comprises a control part extending into an opening of said housing receiving a cap part on said second container and engaging said cap part and latching said cap part to said transfer device when said cap part is fully received in said transfer device for simultaneous axial movement therewith to the unlocked position.

10. A container transfer system according to claim 1 wherein inwardly projecting detents on said outer circumference of said disk form a snap connection between said disk and a circumferential edge of a cap part on said second container in an end position of the unlocked position.

* * * * *